US008688009B2

(12) United States Patent
Liu et al.

(10) Patent No.: US 8,688,009 B2
(45) Date of Patent: Apr. 1, 2014

(54) DELIVERY APPARATUS

(75) Inventors: Yu Liu, Mississauga (CA); Johann Junginger, Toronto (CA); Gaetano J. Lavigne, Burlington (CA); Sarah J. Vella, Milton, CA (US); Vladislav Skorokhod, Concord (CA); Nan-Xing Hu, Oakville (CA); Gregory M. McGuire, Oakville (CA)

(73) Assignee: Xerox Corporation, Norwalk, CT (US)

( * ) Notice: Subject to any disclaimer, the term of this patent is extended or adjusted under 35 U.S.C. 154(b) by 105 days.

(21) Appl. No.: 13/533,475

(22) Filed: Jun. 26, 2012

(65) Prior Publication Data

US 2013/0343782 A1 Dec. 26, 2013

(51) Int. Cl.
*G03G 15/02* (2006.01)
*G03G 21/00* (2006.01)

(52) U.S. Cl.
USPC ..... 399/176; 399/346; 399/349

(58) Field of Classification Search
USPC ..... 399/123, 176, 324, 325, 343, 349, 350
See application file for complete search history.

(56) References Cited

U.S. PATENT DOCUMENTS

| | | | |
|---|---|---|---|
| 3,121,006 A | 2/1964 | Middleton et al. | |
| 4,387,980 A | 6/1983 | Ueno et al. | |
| 4,435,074 A | 3/1984 | Midorikawa et al. | |
| 4,464,450 A | 8/1984 | Teuscher | |
| 4,587,189 A | 5/1986 | Hor et al. | |
| 4,664,995 A | 5/1987 | Horgan et al. | |
| 4,921,773 A | 5/1990 | Melnyk et al. | |
| 5,069,993 A | 12/1991 | Robinette et al. | |
| 5,384,929 A | 1/1995 | Smith | |
| 5,499,089 A | 3/1996 | Tsukamoto et al. | |
| 5,646,718 A | 7/1997 | Suwa et al. | |
| 5,756,245 A | 5/1998 | Esteghamatian et al. | |
| 6,434,357 B1 | 8/2002 | Maul et al. | |
| 6,582,222 B1 | 6/2003 | Chen et al. | |
| 6,869,918 B2 | 3/2005 | Cornelius | |
| 7,428,402 B2 | 9/2008 | Hays et al. | |
| 7,526,243 B2 * | 4/2009 | Zaman et al. | 399/350 |
| 7,580,655 B2 | 8/2009 | Nukada et al. | |
| 7,725,069 B2 | 5/2010 | Kawahara et al. | |
| 7,734,242 B2 | 6/2010 | Hatakeyama et al. | |

(Continued)

FOREIGN PATENT DOCUMENTS

JP 2002357983 A 12/2002

OTHER PUBLICATIONS

U.S. Appl. No. 13/192,252, filed Jul. 27, 2011.
U.S. Appl. No. 13/192,215, filed Jul. 27, 2011.

(Continued)

*Primary Examiner* — Hoang Ngo
(74) *Attorney, Agent, or Firm* — Hoffman Warnick LLC

(57) ABSTRACT

There is described an applicator for use in an image forming apparatus. The applicator includes an applicator comprising an elastomeric matrix and a functional material dispersed therein. The applicator includes an actuator for moving the applicator between a first position having the applicator in contact with a surface, and a second position. The actuator moves the applicator from the first position to the second position at a frequency of from about $10^{-5}$ Hz to about 10 kHz wherein the functional material diffuses from the elastomeric matrix to the surface.

20 Claims, 5 Drawing Sheets

(56) References Cited

U.S. PATENT DOCUMENTS

| | | | | |
|---|---|---|---|---|
| 7,877,054 | B1 * | 1/2011 | Thayer et al. | 399/346 |
| 7,881,651 | B2 | 2/2011 | Watanabe | |
| 7,960,082 | B2 | 6/2011 | Aziz et al. | |
| 2003/0118372 | A1 | 6/2003 | Kitano et al. | |
| 2005/0163527 | A1 | 7/2005 | Tombs | |
| 2009/0087213 | A1 | 4/2009 | Takaya et al. | |
| 2009/0162092 | A1 | 6/2009 | Hoshio | |
| 2010/0189461 | A1 | 7/2010 | Shintani et al. | |
| 2011/0033798 | A1 | 2/2011 | Kim et al. | |
| 2011/0123239 | A1 | 5/2011 | Azeyanagi et al. | |
| 2011/0206430 | A1 | 8/2011 | Arai et al. | |

OTHER PUBLICATIONS

U.S. Appl. No. 13/020,738, filed Feb. 3, 2011.

U.S. Appl. No. 12/845,662, filed Jul. 28, 2010.

U.S. Appl. No. 13/286,905, filed Nov. 1, 2011.

Sanghera, U.S. Appl. No. 13/354,022, Office Action dated Aug. 8, 2013, 25 pages.

Walsh, U.S. Appl. No. 13/279,981, Office Action dated Nov. 6, 2013, 20 pages.

U.S. Appl. No. 13/437,472, Office Action, 20111429-US-NP, XRX-0075, Dec. 20, 2013, 18 pages.

* cited by examiner

DELIVERY APPARATUS

BACKGROUND

1. Field of Use

This disclosure is generally directed to the delivery of a functional material or lubricant to the surface of imaging members, photoreceptors, photoconductors, and the like.

2. Background

In electrophotography or electrophotographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor forms an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

The described electrophotographic copying process is well known and is commonly used for light lens copying of an original document. Analogous processes also exist in other electrophotographic printing applications such as, for example, digital laser printing and reproduction where charge is deposited on a charge retentive surface in response to electronically generated or stored images.

To charge the surface of a photoreceptor (P/R), a contact type charging device has been used, such as disclosed in U.S. Pat. No. 4,387,980 and U.S. Pat. No. 7,580,655, which are incorporated herein by reference in their entirety. The contact type charging device, also termed "bias charge roll" (BCR), includes a conductive member which is supplied a voltage from a power source with a D.C. voltage superimposed with an A.C. voltage of no less than twice the level of the D.C. voltage. The charging device contacts the image bearing member (photoreceptor) surface, which is a member to be charged.

Electrophotographic photoreceptors can be provided in a number of forms. For example, the photoreceptors can be a homogeneous layer of a single material, such as vitreous selenium, or it can be a composite layer containing a photoconductive layer and another material. In addition, the photoreceptor can be layered. Multilayered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

In recent years, organic photoreceptors have been widely used for electrographic purposes. This is because organic photoreceptors are easy to prepare at low cost and have the advantages of mechanical flexibility, easy disposability and environmental sustainability. However, the microcorona generated during repetitive charging damages the organic photoconductor, resulting in a rapid wear of the imaging surface and shortening the life of the photoreceptor.

To further increase the service life of the photoreceptor, use of overcoat layers has also been implemented to protect photoreceptors and improve performance, such as wear resistance. However, these low wear overcoats are associated with poor image quality in a humid environment as the wear rates decrease to a certain level. In addition, high friction associated with low wear overcoats in A-zone also causes severe issues with BCR charging systems, such as motor failure due to high friction/torque and blade damage. As well, toner or additive particles remaining on the photoreceptor after transferring could not be effectively cleaned by the cleaning blade. As a result, use of a low wear overcoat with BCR charging systems is still a challenge, and there is a need to find ways to increase the life of the photoreceptor with excellent image quality and charging performance.

An applicator to continuously apply functional material (such as paraffin oil) to the surface of the photoreceptor was disclosed in patent applications, U.S. Ser. No. 13/279,981 and U.S. Ser. No. 13/326,414 incorporated in their entirety by reference herein. The applied thin layer of functional material addresses A-zone deletion, alleviates chattering of the cleaning blade, and reduces toner/additive contamination on the BCR. However, as a roll-type design, the applicator is difficult to control the contact force of the roller surface against the surface of the photoreceptor or the BCR along the entire length during rotation, which affects the rate of diffusion of oil from the delivery roller and results in an uneven distribution of oil, particularly at the two ends of the photoreceptor or BCR surface. As a result, after long term prints, toner density across a page becomes uneven, thus the edges of the images sometimes become darker than the middle due to an excess amount of delivered oil. This can further cause the delivery roller to become contaminated with toner and additives over time due to inefficient cleaning of the surface of the photoreceptor (P/R) by the cleaning blade. Toner particles are eventually transferred to and contaminate the surface of the BCR.

In U.S. Ser. No. 13/437,472, a blade applicator to apply an ultra thin layer of liquid phase functional materials on the surface of a P/R or a surface of a BCR is described. The blade applicator is in contact with the P/R surface or the BCR surface in a trailing configuration. However, the friction between the applicator and the surface of the P/R or the surface of the BCR can cause the contact edge on the blade to wear and cause non-uniform diffusion of the functional material on the surface of the P/R or the surface of the BCR. In addition, long term wear of the contact edge of the blade can result in contamination of toner or additives which can lever the blade edge away from surface of the P/R or the surface of the BCR, creating areas on the surface of the P/R or the surface of the BCR where no functional material is applied. This can cause damage of cleaning blade and image failure.

SUMMARY

Disclosed herein is an applicator for use in an image forming apparatus. The applicator includes an applicator comprising an elastomeric matrix and a functional material dispersed therein. The applicator includes an actuator for moving the applicator between a first position having the applicator in contact with a surface, and a second position. The actuator moves the applicator from the first position to the second position at a pre-determined frequency wherein the functional material diffuses from the elastomeric matrix to the surface.

Disclosed herein is an image forming apparatus comprising an image bearing member, a charging unit for applying an electrostatic charge on the image bearing member to a predetermined electric potential, an exposing unit that exposes a surface of the image bearing member charged by the charging unit to form an electrostatic latent image, a developing unit that develops the electrostatic latent image using a developer containing toner to form a toner image, a transferring unit that transfers the toner image to a recording medium, and a cleaning unit that removes toner remaining on the surface of the image bearing member. The image forming apparatus includes an applicator for applying a functional material. The applicator includes a applicator comprising an elastomeric matrix and a functional material dispersed therein, wherein the applicator is positioned in contact with a surface of the imaging member or the charging unit and an actuator for moving the applicator between a first position having the applicator in contact with the surface, and a second position. The actuator moves the applicator from the first position to the second position at a pre-determined frequency wherein the functional material diffuses from the elastomeric matrix to the surface.

Disclosed herein is an applicator for use in an image forming apparatus. The image forming apparatus includes an image bearing member, a contact charging unit for applying an electrostatic charge on the image bearing member to a predetermined electric potential and an applicator. The applicator comprises an applicator comprising an elastomeric matrix and a functional material dispersed therein, wherein the applicator is positioned in contact with a surface of the imaging member or the charging unit and an actuator for moving the applicator between a first position having the applicator in contact with the surface, and a second position. The actuator moves the applicator from the first position to the second position at a pre-determined frequency wherein the functional material diffuses from the elastomeric matrix to the surface.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

In the following description, reference is made to the chemical formulas that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

The disclosed embodiments are directed generally to a delivery applicator for applying a layer of a functional material that acts as a lubricant on an imaging member surface. The layer of functional material acts as a barrier against moisture and/or surface contaminants, thereby protecting the surface of the imaging member. The application of the lubricant provides improved wear resistance, low friction, and reduced image defects due to deletion in high humidity conditions, which leads to improved xerographic performance in imaging members.

Figure 1:
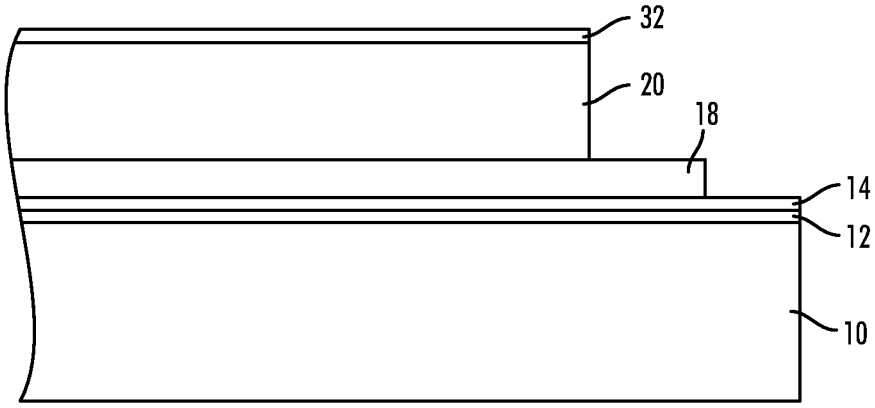
FIG. 1 is a cross-sectional view of an imaging member in a drum configuration according to the present embodiments.

FIG. 1 is an exemplary embodiment of a multilayered electrophotographic imaging member or photoreceptor having a drum configuration. The substrate may further be in a cylinder configuration. As can be seen, the exemplary imaging member includes a rigid support substrate 10, an electrically conductive ground plane 12, an undercoat layer 14, a charge generation layer 18 and a charge transport layer 20. An optional overcoat layer 32 disposed on the charge transport layer 20 may also be included. The substrate 10 may be a material selected from the group consisting of a metal, metal alloy, aluminum, zirconium, niobium, tantalum, vanadium, hafnium, titanium, nickel, stainless steel, chromium, tungsten, molybdenum, and mixtures thereof. The substrate 10 may also comprise a material selected from the group consisting of a metal, a polymer, a glass, a ceramic, and wood.

The charge generation layer 18 and the charge transport layer 20 form an imaging layer described herein as two separate layers. In an alternative to what is shown in the figure, the charge generation layer 18 may also be disposed on top of the charge transport layer 20. It will be appreciated that the functional components of these layers may alternatively be combined into a single layer.

Figure 2:
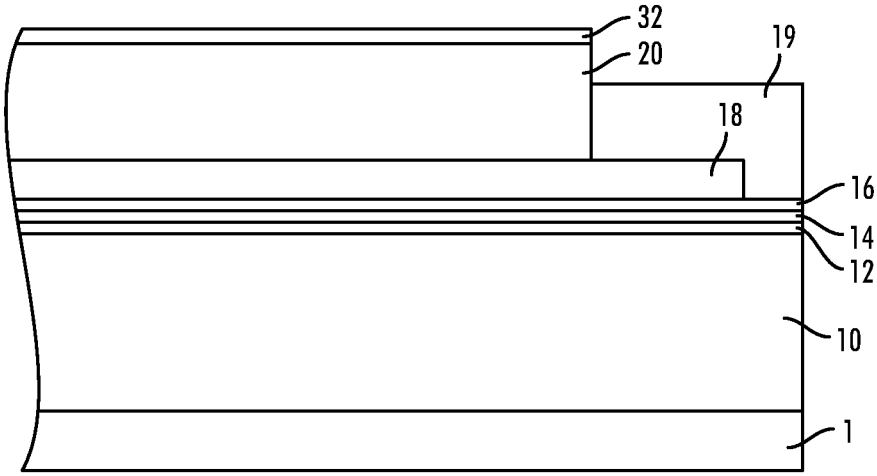
FIG. 2 is a cross-sectional view of an imaging member in a belt configuration according to the present embodiments.

FIG. 2 shows an imaging member or photoreceptor having a belt configuration according to the embodiments. As shown, the belt configuration is provided with an anti-curl back coating 1, a supporting substrate 10, an electrically conductive ground plane 12, an undercoat layer 14, an adhesive layer 16, a charge generation layer 18, and a charge transport layer 20. An optional overcoat layer 32 and ground strip 19 may also be included. An exemplary photoreceptor having a belt configuration is disclosed in U.S. Pat. No. 5,069,993, which is hereby incorporated by reference in its entirety.

As discussed above, an electrophotographic imaging member generally comprises at least a substrate layer, an imaging layer disposed on the substrate and an optional overcoat layer disposed on the imaging layer. In further embodiments, the imaging layer comprises a charge generation layer disposed on the substrate and the charge transport layer disposed on the charge generation layer. In other embodiments, an undercoat layer may be included and is generally located between the substrate and the imaging layer, although additional layers may be present and located between these layers. The imaging member may also include an anti-curl back coating layer in certain embodiments. The imaging member can be employed in the imaging process of electrophotography, where the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing charged particles of the same or opposite polarity on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Common print quality issues are strongly dependent on the quality and interaction of these photoreceptor layers. For example, when a photoreceptor is used in combination with a contact charger and a toner obtained by chemical polymerization (polymerization toner), image quality may be deteriorated due to a surface of the photoreceptor being stained with a discharge product produced in contact charging or the polymerization toner remaining after a cleaning step. Still further, repetitive cycling causes the outermost layer of the photoreceptor to experience a high degree of frictional contact with other machine subsystem components used to clean and/or prepare the photoreceptor for imaging during each cycle. When repeatedly subjected to cyclic mechanical interactions against the machine subsystem components, a photoreceptor can experience severe frictional wear at the outermost organic photoreceptor layer surface that can greatly reduce the useful life of the photoreceptor. Ultimately, the resulting wear impairs photoreceptor performance and thus image quality. Another type of common image defect is thought to result from the accumulation of charge somewhere in the photoreceptor. Consequently, when a sequential image is printed, the accumulated charge results in image density changes in the current printed image that reveals the previously printed image. In the xerographic process spatially varying amounts of positive charges from the transfer station find themselves on the photoreceptor surface. If this variation is large enough it will manifest itself as a variation in the image potential in the following xerographic cycle and print out as a defect.

A conventional approach to photoreceptor life extension is to apply an overcoat layer with wear resistance. For bias charge roller (BCR) charging systems, overcoat layers are associated with severe imaging quality problem, and cleaning inefficiency. After long term cycling under BCR charging, the P/R surface with less wear rate is severely degraded and could be effectively refreshed. Degraded surface shows decreased surface energy which results both of charging lateral migration and high adhesion force between cleaning system and P/R surface. High adhesion caused cleaning system i.e. cleaning blade chattering to less effectively clean toner or additive particles remaining on P/R surface after transferring. These particles accumulate on BCR surface or P/R surface to cause BCR contamination and background on printing image. The present embodiments provide photoreceptor technology for BCR charging systems with a significantly expanded life.

Disclosed herein is an applicator for applying functional materials on a P/R surface or a BCR surface. The applicator is dynamically pulsed during operation. During the pulsing, the applicator is intermittently contacting with the P/R surface at a pulsed time and minimizes the frictional motion between the applicator and P/R surface. In embodiments, the applicator remains in contact with the surface of the P/R or the surface of the BCR but the pressure of the applicator on the surface is varied between a first position at a first pressure and a second position at a second pressure wherein the second pressure is less than the first pressure. The applicator is pulsed from the first position to the second position at a frequency of from about $10^{-5}$ Hz to about 10 kHz, or from about 0.01 Hz to about 5 kHz, or from about 1 Hz to 1 kHz, or from 50 Hz to 500 Hz. During each cycle of the applicator moving in and out of contact with P/R surface, the duty cycle for the contact in the first position is from about 5% to about 95%, or from about 15% to about 85%, or from 30% to about 70%, or from 40% to about 60%, or about 50%.The embodiments result in reduced friction force between the applicator and the P/R surface or the BCR surface. The pulsing of the applicator does not introduce any visible increase or disturbance on torque of the P/R drum motor. The applicator can be positioned in a trailing or leading configuration.

In embodiments, the applicator is in contact with the P/R surface at the first position, wherein a liquid functional material diffused from the applicator onto the P/R surface to form an ultra-thin layer coating on the P/R surface. Such a thin layer of functional material could sustain its functionalities for many cycles, for example more than 100 cycles. Furthermore, even though the applicator is only making contact with one portion of the whole P/R surface at the first position, the liquid functional material as applied on the portion of the P/R surface could be still evenly leveled by the cleaning blade at the cleaning stage or the BCR at the charging stage to form a uniform layer on the P/R surface. Therefore, regarding both of characteristics of the applicator, the functional material as applied at the first position can be effectively delivered to the whole P/R surface, even though at the second position wherein the applicator is out of contact with the P/R surface.

In embodiments, the applicator can be a blade type applicator or a roller type applicator. These will be described in more detail below.

Figure 3:
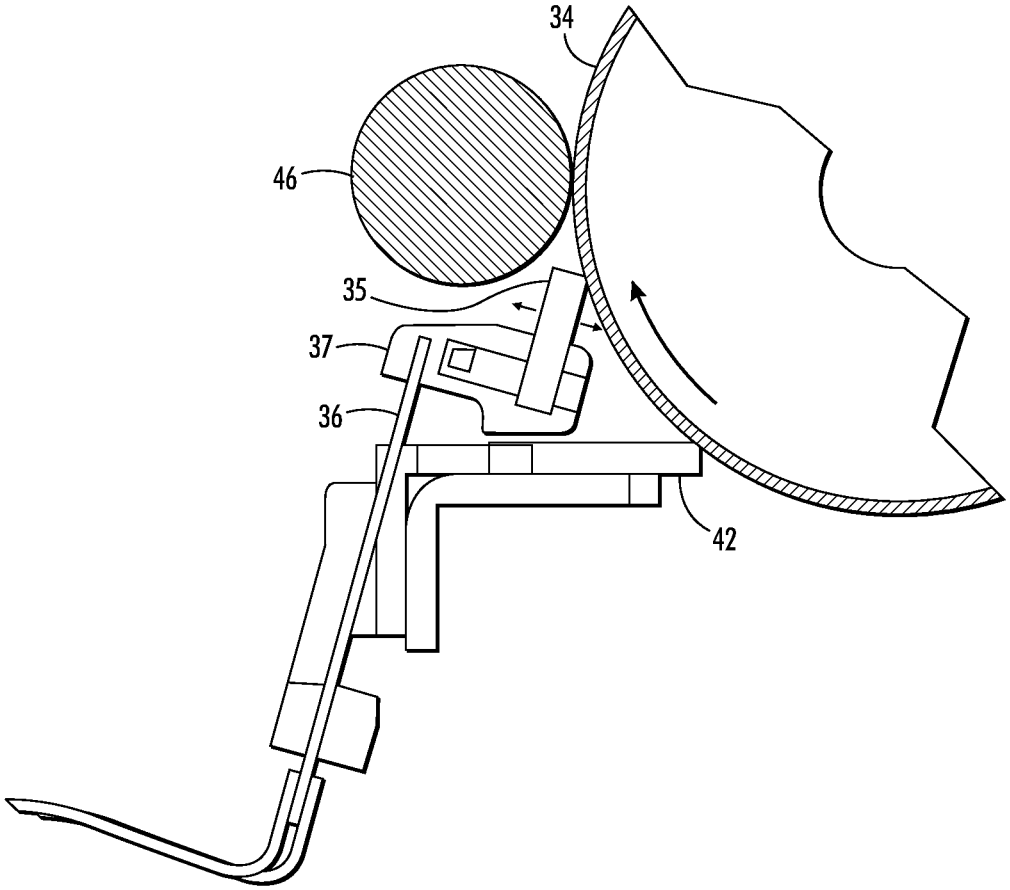
FIG. 3 is a cross-sectional view of a system implementing a applicator according to the present embodiments.

As shown in FIG. 3, the major components of the system of the applicator disclosed herein include an elastomeric blade applicator 35 which also functions as a reservoir for the functional material(s) (e.g. paraffin oil or silicone oil). A roller type applicator can be substituted for the blade type applicator in certain embodiments. A holder 37 secures the applicator 35 and is movable by actuator 36. The applicator 35 is shown in trailing position with respect to the surface of the P/R. The applicator 35 can also be in a leading position with respect to a surface. The arrows around the applicator 35 show the direction of movement. The actuator 36 is capable of moving at different frequencies to tap the applicator 35 in a pulsed contact with surface of P/R 34. The actuator 36 is selected from a piezo transducer, electrical motor, pneumatic actuator, hydraulic actuator, linear actuator, combo drive, thermal bimorphs and electroactive polymers.

The holder 37 and the actuator can be attached to the cleaning housing (not shown) imaging apparatus. The attachment can be accomplished through mechanical or magnetic force.

The applicator 35 is comprised of an elastomeric matrix having functional materials such as paraffin oil dispersed therein. The functional material diffuses through the elastomeric matrix onto a P/R surface. The metering of functional material can be controlled by the contact pressure and contact time during pulsing between the blade and the surface of the P/R or the surface of the BCR.

In the configuration shown in FIG. 3, the applicator 35 applies an ultrathin layer of functional materials on the surface 34 to suppress image deletion in high humidity environment and reduce friction between the cleaning blade 42 and the P/R surface 34 during longer-term printing, extending the life of the photoreceptor 34. Effective suppression of contamination on the BCR associated with low wear overcoated P/Rs is also provided by the applicator 35.

Figure 4:
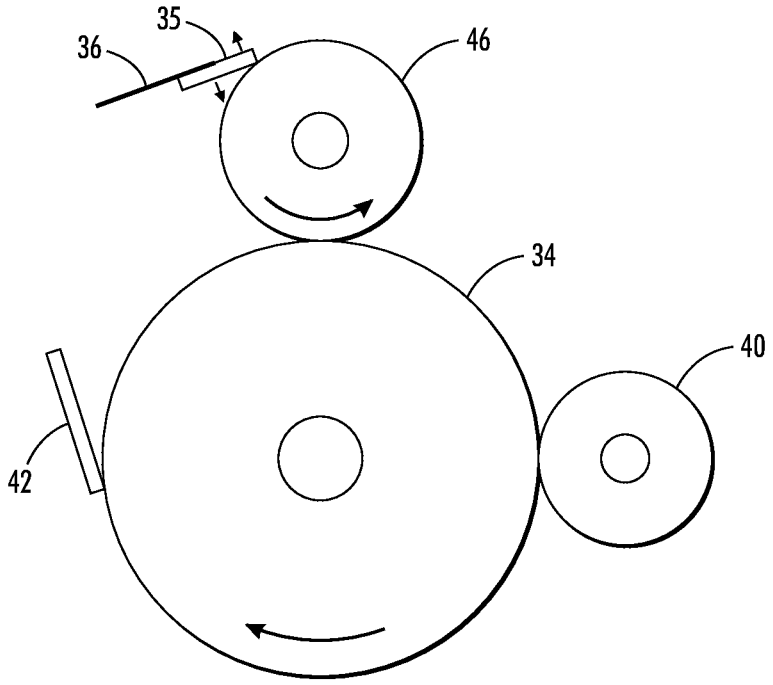
FIG. 4 is an alternative cross-sectional view of a system implementing a applicator according to the present embodiments.
Figure 5:
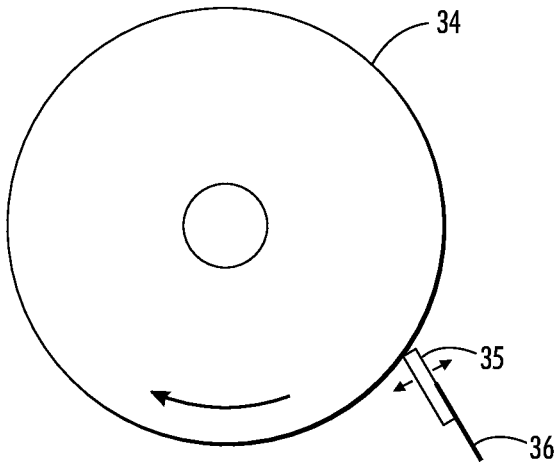
FIG. 5 is an alternative cross-sectional view of a system implementing a applicator according to the present embodiments.

In FIG. 4, there is illustrated an alternative embodiment image-forming apparatus in a BCR charging system. As shown, the image-forming apparatus comprises a photoreceptor 34, a BCR 46 and an applicator 35. The applicator 35 contacts the BCR 46 which in turn contacts the photoreceptor 34 to deliver an ultra-thin layer of a functional material onto the surface of the photoreceptor 34 indirectly. A holder 37 secures the applicator 35 and is movable by actuator 36. The applicator 35 is shown in trailing position with respect to the surface of the BCR. The applicator 35 can also be in a leading position with respect to a surface as shown in FIG. 5. The arrows around blade applicator 35 show the direction of movement. The actuator 36 is capable of moving at different frequencies to tap or pulse the blade applicator 35 in a pulsed contact with surface of P/R 34. The photoreceptor 34 is substantially uniformly charged by the BCR 46 to initiate the electrophotographic reproduction process. The charged photoreceptor is then exposed to a light image to create an electrostatic latent image on the photoreceptive member (not shown). This latent image is subsequently developed into a visible image by a toner developer 40. Thereafter, the developed toner image is transferred from the photoreceptor member through a record medium to a copy sheet or some other image support substrate to which the image may be permanently affixed for producing a reproduction of the original document (not shown). The photoreceptor surface is generally then cleaned with a cleaner 42 to remove any residual developing material therefrom in preparation for successive imaging cycles.

An embodiment shown in FIG. 5 includes the applicator 35 which also functions as a reservoir for the functional material(s) (e.g. paraffin oil or silicone oil). The applicator 35 and is movable by actuator 36. The applicator 35 is shown in a leading position with respect to the surface 34 of the P/R. The arrows around the applicator 35 show the direction of movement. The actuator 36 is capable of moving at different frequencies to tap the applicator 35 in a pulsed contact with surface of P/R 34.

In embodiments of the applicator 35 shown in FIGS. 3-5 a blade is depicted. In alternate embodiments the applicator can be a roller as described in U.S. Ser. Nos. 13/292,252, 13/192,215 and 13/279,981 incorporated in their entirety by reference herein. In either the blade or roller configuration one or more layers of elastomeric material can be provided to serve as a reservoir for the functional material and to meter the functional material to the surface of the P/R or the surface of the BCR.

The contact force of the edge of the applicator in contact with the P/R surface across the whole contact length can be varied through the actuator 36. The actuator 36 moves the blade applicator from a position of contact with the surface of either the P/R or BCR to a position of no contact with the surface. In embodiments the blade applicator is moved from a first position at a first force on the surface to a second position at a second force less than the force in the first position.

In the embodiment the thickness of the applicator 35 may be varied depending on the application requirements and whether the applicator is a blade or roller. In embodiments, the thickness using a blade applicator of the layer of the surface of the applicator contacting the P/R surface or BCR surface is from about 0.1 mm to about 50 mm. In embodiments, the thickness of the layer of the surface of the applicator contacting the P/R surface or BCR surface is from about 1 mm to about 30 mm, or from about 5 mm to about 25 mm. In embodiments, the thickness using a roller applicator of the layer of the surface of the applicator contacting the P/R surface is dependent on the elasticity of the outer surface of the roller and the force applied on the roller.

In embodiments where the applicator is a blade, the geometry of the tip of blade may be shaped. These include a polygonal prism, a triangular prism, a cuboid, or a sphere. The orientation of the tip shape can be varied.

In embodiments of an applicator being a blade or a roller, there can be more than one layer. Such multilayer applicators include an inner layer having pores of a size from about 10 nm to about 100 μm, or from about 20 nm to about 50 μm or from about 50 nm to about 10 μm which are larger than the pores of the inner layer. The outer layer will have smaller pores of less than about 1 μm, or less than about 500 nm or less than about 300 nm or less that 100 nm or less than 50 nm.

In embodiments the applicator layers can have porous material rather than pores dispersed in the elastomer. The porous material has a porosity of from about 50 percent to about 99.9 percent. The porous material functions as a reservoir to store the functional material. The pores of the porous material are from about 2 nm up to about 50 microns, or the pores are from about 10 nm microns to about 20 microns, or the pores are from about 100 nm to about 17 microns. The pores of the porous material are filled with functional material. An outer layer is provided to control the diffusion of the functional material from the inner layer and comprises elastomeric material and functional material. The applicator applies an ultra-thin film of functional material to the surface of a photoreceptor either directly or indirectly which: i) reduces friction between the P/R and the cleaning blade and ii) eliminates A-zone deletions, both of which improve image quality.

The incorporation of a solid, porous material, for example silica aerogel, increases the amount of functional material (particularly one that is incompatible with the elastomeric matrix) stored in the delivery roller. Paraffin oil and PDMS are immiscible, which limits the quantity of paraffin oil that can be dispersed in a PDMS matrix to about 33 weight percent of the layer. Silica aerogels, which can have porosities up to 99.9 percent, absorb paraffin oil and stabilize its dispersion in the elastomeric matrix. The applicator described herein provides a way to store larger quantities of functional material in the delivery roller and increases its overall lifetime.

In embodiments, the functional material can be an organic or inorganic compound, oligomer or polymer, or a mixture thereof. The functional materials may be in the form of liquid, wax, or gel, and a mixture thereof. The functional material may also be selected from the group consisting of a lubricant material, a hydrophobic material, an oleophobic material, an amphiphilic material, and mixtures thereof. Illustrative examples of functional materials may include, for example, a liquid material selected from the group consisting of hydrocarbons, fluorocarbons, mineral oil, synthetic oil, natural oil, and mixtures thereof. The functional materials may further contain a functional group that facilitates adsorption of the functional materials on the photoreceptor surface, and optionally a reactive group that can chemically modify the photoreceptor surface. For examples, the functional materials may comprise paraffinic compound, alkanes, fluoroalkanes, alkyl silanes, fluoroalkyl silanes alkoxy-silanes, siloxanes, glycols or polyglycols, mineral oil, synthetic oil, natural oil or mixture thereof.

In embodiments, the applicator may be comprised of a polymer selected from the group consisting of polysiloxanes, polyurethanes, polyesters, fluoro-silicones, polyolefin, fluoroelastomers, synthetic rubber, natural rubber, and mixtures thereof.

The porous material is selected from the group consisting of aerogel particles, ceramic particles, polymers, foam, wood and glass. The porosity of the porous material is from about 50 percent to about 99.9 percent. In embodiments the porosity of the porous material is from about 60 percent to about 99 percent, or from about 65 percent to about 95 percent. The porous material and functional material comprise about 50 weight percent to about 90 weight percent of the blade applicator 35.

In general, a wide range of aerogel components are known in the art and have been applied in a variety of uses. One specific non-limiting example is the commercially available powder that has already been chemically treated, Dow Corning VM-2270 Aerogel fine particles having a size of about 5-15 microns.

In embodiments, the blade applicator 35 contains an elastomeric matrix comprised of a polymer selected from the group consisting of polysiloxane, silicones, polyurethane, polyester, fluoro-silicone, polyolefin, fluoroelastomer, synthetic rubber, natural rubber and mixtures thereof.

In embodiments, the blade applicator 35 in FIG. 5 is an elastomeric material cast with the porous material by use of a mold. Thereafter, the elastomeric matrix is cured. The blade applicator 35 is impregnated with a functional material, such as paraffin by immersion. After curing, the elastomeric matrix containing the porous material and functional material is extracted from the mold.

The applicator is tapped at a frequency to make pulsed contact with P/R surface 34 or the surface of the BCR 46. Friction between the applicator and a surface can be minimized through tuning the pulsing frequency. The pulsing of the applicator 35 suppresses contamination and wear on the applicator and the surface of the P/R or the surface of the BCR.

In a specific embodiment, the blade applicator 35 is a paraffin-impregnated cross-linkable polydimethylsiloxane PDMS that includes the porous material. The blade applicator 35 of paraffin-impregnated silicone is prepared by mixing paraffin into a cross-linkable PDMS and the porous material, such as aerogel particles, and then casting the mixture by use of a mold. Thereafter, the PDMS is cured. The blade applicator 35 is impregnated with a functional material, such as paraffin by immersion. After curing, the blade applicator 35 is removed from the mold. In embodiments, an outer layer prepared by mixing a cross-linkable polydimethylsiloxane (PDMS) and then casting the mixture into the blade applicator 35 by use of a mold. In embodiments, the liquid cross-linkable PDMS is prepared from a two-component system, namely, a base agent and a curing agent. In further embodiments, the base agent and curing agent are present in a weight ratio of from about 50:1 to about 2:1, or from about 20:1 to about 5:1 in both inner and outer layers. In embodiments, the weight ratio of the elastomeric material to the porous material and functional material of the layer 63 is at a weight ratio of from about 20:1 to about 1:5, or from about 10:1 to about 1:5 or from about 3:1 to about 1:3.

The description below describes embodiments of photoconductors

The Overcoat Layer

Other layers of the imaging member may include, for example, an optional over coat layer 32. The optional overcoat layer 32, if desired, may be disposed over the charge transport layer 20 to provide imaging member surface protection as well as improve resistance to abrasion. In embodiments, the overcoat layer 32 may have a thickness ranging from about 0.1 micrometer to about 15 micrometers or from about 1 micrometer to about 10 micrometers, or in a specific embodiment, about 3 micrometers to about 10 micrometers. These overcoating layers typically comprise a charge transport component and an optional organic polymer or inorganic polymer. These overcoating layers may include thermoplastic organic polymers or cross-linked polymers such as thermosetting resins, UV or e-beam cured resins, and the like. The overcoat layers may further include a particulate additive such as metal oxides including aluminum oxide and silica, or low surface energy polytetrafluoroethylene (PTFE), and combinations thereof.

Any known or new overcoat materials may be included for the present embodiments. In embodiments, the overcoat layer may include a charge transport component or a cross-linked charge transport component. In particular embodiments, for example, the overcoat layer comprises a charge transport component comprised of a tertiary arylamine containing a substituent capable of self cross-linking or reacting with the polymer resin to form a cured composition. Specific examples of charge transport components suitable for overcoat layer comprise the tertiary arylamine with a general formula of

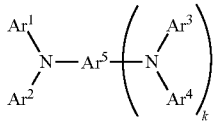

wherein $Ar^1$, $Ar^2$, $Ar^3$, and $Ar^4$ each independently represents an aryl group having about 6 carbon atoms to about 30 carbon atoms, $Ar^5$ represents aromatic hydrocarbon group having about 6 carbon atoms to about 30 carbon atoms, and k represents 0 or 1, and wherein at least one of $Ar^1$, $Ar^2$, $Ar^3$ $Ar^4$, and $Ar^5$ comprises a substituent selected from the group consisting of hydroxyl (—OH), a hydroxymethyl (—$CH_2OH$), an alkoxymethyl (—$CH_2OR$, wherein R is an alkyl having 1 carbon atoms to about 10 carbons), a hydroxylalkyl having 1 carbon atoms to about 10 carbons, and mixtures thereof. In other embodiments, $Ar^1$, $Ar^2$, $Ar^3$, and $Ar^4$ each independently represent a phenyl or a substituted phenyl group, and $Ar^5$ represents a biphenyl or a terphenyl group.

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be a single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, as shown in FIG. 2, the belt can be seamed or seamless. In embodiments, the photoreceptor herein is in a drum configuration.

The thickness of the substrate 10 depends on numerous factors, including flexibility, mechanical performance, and economic considerations. The thickness of the support substrate 10 of the present embodiments may be at least about 500 micrometers, or no more than about 3,000 micrometers, or be at least about 750 micrometers, or no more than about 2500 micrometers.

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

The Hole Blocking Layer

After deposition of the electrically conductive ground plane layer, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl)methyl diethoxysilane.

General embodiments of the undercoat layer may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The hole blocking layers that contain metal oxides such as zinc oxide, titanium oxide, or tin oxide, may be thicker, for example, having a thickness up to about 25 micrometers. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of between about 0.05:100 to about 0.5:100 for the hole blocking layer material and solvent is satisfactory for spray coating.

The Charge Generation Layer

The charge generation layer 18 may thereafter be applied to the undercoat layer 14. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 nm and about 900 nm during the imagewise radiation exposure step in an electrophotographic imaging process to form an electrostatic latent image. For example, hydroxygallium phthalocyanine absorbs light of a wavelength of from about 370 nm to about 950 nm, as disclosed, for example, in U.S. Pat. No. 5,756,245, the entire disclosure thereof being incorporated herein by reference.

Any suitable inactive resin materials may be employed as a binder in the charge generation layer 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer 18 may have a thickness of at least about 0.1 μm, or no more than about 2 μm, or of at least about 0.2 μm, or no more than about 1 μm. These embodiments may be comprised of chlorogallium phthalocyanine or hydroxygallium phthalocyanine or mixtures thereof. The charge generation layer 18 containing the charge generating material and the resinous binder material generally ranges in thickness of at least about 0.1 μm, or no more than about 5 μm, for example, from about 0.2 μm to about 3 μm when dry. The charge generation layer thickness is generally related to binder content. Higher binder content compositions generally employ thicker layers for charge generation.

The Charge Transport Layer

In a drum photoreceptor, the charge transport layer comprises a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

The charge transport layer 20 is normally transparent in a wavelength region in which the electrophotographic imaging member is to be used when exposure is affected there to ensure that most of the incident radiation is utilized by the underlying charge generation layer 18. The charge transport layer 20 should exhibit excellent optical transparency with negligible light absorption and no charge generation when exposed to a wavelength of light useful in xerography, e.g., 400 nm to 900 nm. In the case when the photoreceptor is prepared with the use of a transparent substrate 10 and also a transparent or partially transparent conductive layer 12, imagewise exposure or erasure may be accomplished through the substrate 10 with all light passing through the back side of the substrate 10. In this case, the materials of the charge transport layer 20 need not transmit light in the wavelength region of use if the charge generation layer 18 is sandwiched between the substrate 10 and the charge transport layer 20. The charge transport layer 20 in conjunction with the charge generation layer 18 is an insulator to the extent that an electrostatic charge placed on the charge transport layer 20 is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer 20. The high mobility charge transport component may comprise small molecules of an organic compound which cooperate to transport charge between molecules and ultimately to the surface of the charge transport layer 20. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally is of a thickness of from about 5 micrometers to about 75 micrometers, and more specifically, of a thickness of from about 15 micrometers to about 40 micrometers. Examples of charge transport components are aryl amines.

Examples of the binder materials selected for the charge transport layers include components, such as those described in U.S. Pat. No. 3,121,006, the disclosure of which is totally incorporated herein by reference in its entirety. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer 20, such as a hole transport layer, may have a thickness of at least about 10 μm, or no more than about 40 μm.

The charge transport layer 20 should be an insulator to the extent that the electrostatic charge placed on the hole transport layer is not conducted in the absence of illumination at a rate sufficient to prevent formation and retention of an electrostatic latent image thereon. The charge transport layer 20 is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

In addition, in the present embodiments using a belt configuration, the charge transport layer 20 may consist of a single pass charge transport layer or a dual pass charge transport layer (or dual layer charge transport layer) with the same or different transport molecule ratios. In these embodiments, the dual layer charge transport layer 20 has a total thickness of from about 10 μm to about 40 μm. In other embodiments, each layer of the dual layer charge transport layer may have an individual thickness of from 2 μm to about 20 μm. Moreover, the charge transport layer 20 may be configured such that it is used as a top layer of the photoreceptor to inhibit crystallization at the interface of the charge transport layer and the overcoat layer. In another embodiment, the charge transport layer 20 may be configured such that it is used as a first pass charge transport layer to inhibit microcrystallization occurring at the interface between the first pass and second pass layers.

The Adhesive Layer

An optional separate adhesive interface layer may be provided in certain configurations, such as for example, in flexible web configurations. In the embodiment illustrated in FIG. 1, the interface layer would be situated between the blocking layer 14 and the charge generation layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

The adhesive interface layer may have a thickness of at least about 0.01 micrometers, or no more than about 900 micrometers after drying. In embodiments, the dried thickness is from about 0.03 micrometers to about 1 micrometer.

The Ground Strip

The ground strip 19 may comprise a film forming polymer binder and electrically conductive particles. Any suitable electrically conductive particles may be used in the electrically conductive ground strip layer 19. The ground strip 19 may comprise materials which include those enumerated in U.S. Pat. No. 4,664,995 incorporated in its entirety by reference herein. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip 19 layer may have a thickness of at least about 7 micrometers, or no more than about 42 micrometers, or of at least about 14 micrometers, or no more than about 27 micrometers.

The Anti-Curl Back Coating Layer

The anti-curl back coating 1 may comprise organic polymers or inorganic polymers that are electrically insulating or slightly semi-conductive. The anti-curl back coating 1 provides flatness and/or abrasion resistance.

Anti-curl back coating 1 may be formed at the back side of the substrate 10, opposite to the imaging layers. The anti-curl back coating 1 may comprise a film forming resin binder and an adhesion promoter additive. The resin binder may be the same resins as the resin binders of the charge transport layer discussed above. Examples of film forming resins include polyacrylate, polystyrene, bisphenol polycarbonate, poly(4,4'-isopropylidene diphenyl carbonate), 4,4'-cyclohexylidene diphenyl polycarbonate, and the like. Adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl back coating is at least about 3 micrometers, or no more than about 35 micrometers, or about 14 micrometers.

Various exemplary embodiments encompassed herein include a method of imaging which includes generating an electrostatic latent image on an imaging member, developing a latent image, and transferring the developed electrostatic image to a suitable substrate.

While embodiments have been illustrated with respect to one or more implementations, alterations and/or modifications can be made to the illustrated examples without departing from the spirit and scope of the appended claims. In addition, while a particular feature herein may have been disclosed with respect to only one of several implementations, such feature may be combined with one or more other features of the other implementations as may be desired and advantageous for any given or particular function.

EXAMPLES

Example 1

Polydimethylsiloxane (PDMS) was prepared from a two components, commercially available systems. The components were mixed in a 10:1 ratio of base to curing agent. Paraffin oil was added to the pre-polymer in a 1 to 2 ratio of oil to pre-polymer. The three components were thoroughly mixed together, and degassed in a vacuum desiccator for about 30 minutes. The resulting emulsion was carefully injected into a rectangular mould (anodized aluminum) using a disposable syringe which was then cured for three hours at about 60°. After curing, the blade was extracted from the mould and mounted onto the bracket. The blade has thickness of about 5 mm, width of about 15 mm, and length of about 130 mm. The bracket was mounted on a PZT actuator (Piezo Systems, Inc.) that moved the blade from a first position to a second position. The PZT actuator was driven by a linear amplifier (EPA-2104-115, Piezo System, Inc.).

This type applicator with tapping or pulsing capability was successfully integrated in a Xerox DocuColor 250 CRU with standard P/R and further installed on a surrogate test fixture with high resolution torque monitoring function for experiments. To exclude impact of interactions between other components on the friction monitoring for comparison, the cleaning blade and BCR were removed from the CRU.

The test was performed in B-zone (22° C., 50% RH). Rotation speed of the P/R was set as 1.5 revolutions per second (rps). Different frequencies were tested through monitoring the torque values. For all of the testing herein, a square wave was applied to drive the PZT with duty cycle kept at 50%. Initially the blade applicator was out of contact with surface of the P/R. There is a minimum torque as measured as baseline. The testing sequence began by placing the applicator in contact with the surface of the P/R for about 20 seconds. The applicator was then programmed to lift up and down at a frequency of 0.1 Hz for about 60 seconds. The PZT frequency was then changed to about 10 Hz for about 60 seconds. The tapping or pulsing frequency was further changed to 200 Hz for about 40 seconds. The tapping or pulsing frequency was changed back to 0.1 Hz for about 20 seconds. The blade applicator was finally lifted up out of contact with the P/R surface.

Figure 6:
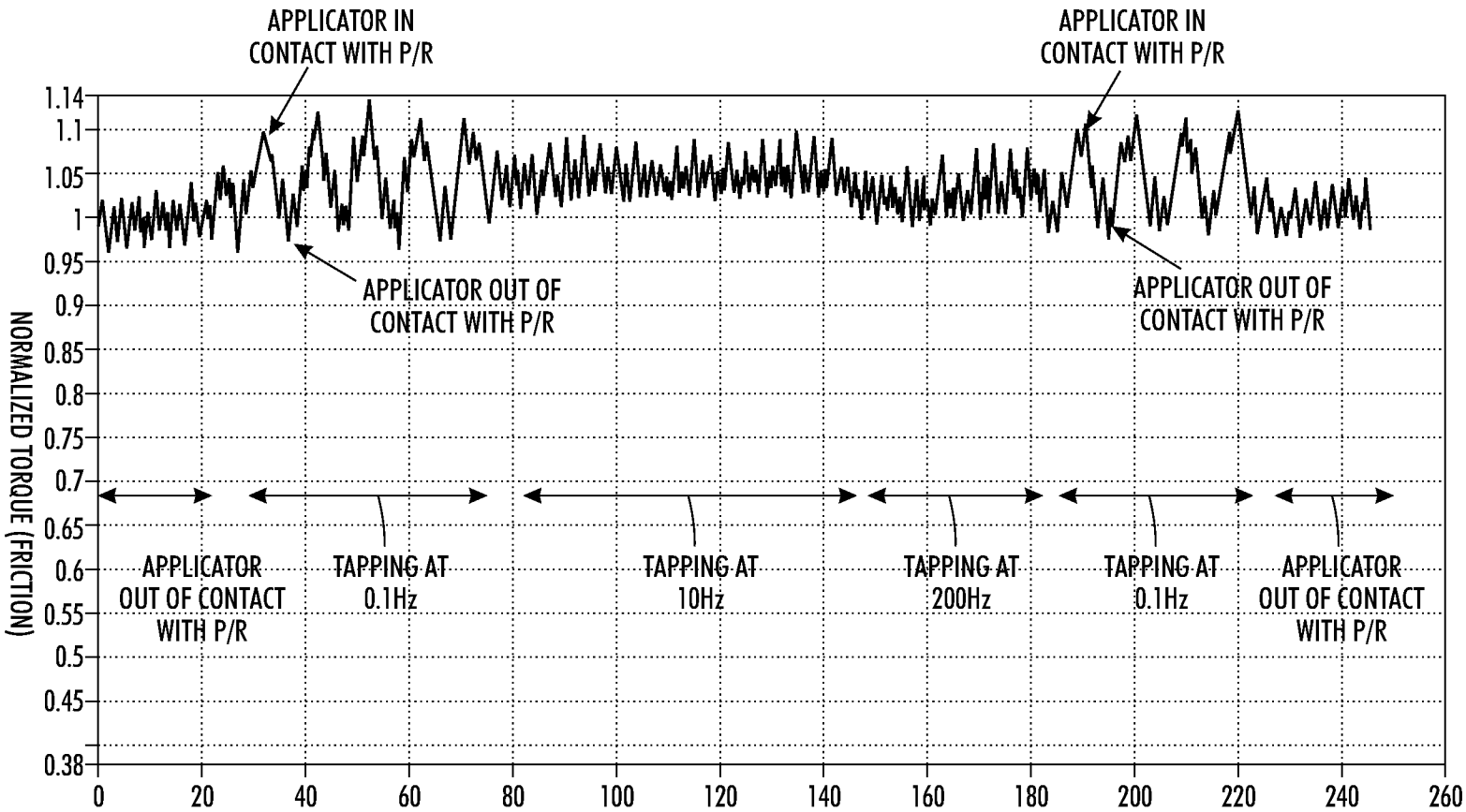
FIG. 6 is a torque test of an applicator according to the present embodiments.

All data (normalized torque) is shown in FIG. 6. Without contact with the surface of the P/R, there was lowest torque (baseline). When a low tapping frequency is added such as 0.1 Hz, the applicator was periodically in or out of contact with P/R surface. When a higher tapping frequency such as 10 Hz was added, there was higher torque than baseline. Herein, the contact time between the applicator and the P/R surface is slightly longer. When a higher frequency of 200 Hz was added, the blade applicator was in a short pulsed contact with the P/R surface and the friction between the applicator and the P/R was totally minimized. The torque at this frequency (200 Hz) is almost same to the baseline.

Another important phenomenon was that at a frequency of 200 Hz the blade applicator on the P/R did not cause any visible disturbance on torque profile. This is important for the imaging process.

Example 2

Polydimethylsiloxane (PDMS) was prepared from a two components, commercially available systems. The components were mixed in a 10:1 ratio of base to curing agent. Paraffin oil was added to the pre-polymer in a 1 to 2 ratio of oil to pre-polymer. The three components were thoroughly mixed together, and degassed in a vacuum desiccator for about 30 minutes. The resulting emulsion was carefully injected into a rectangular mould (anodized aluminum) using a disposable syringe which was then cured for three hours at about 60°. After curing, the blade was extracted from the mould and mounted onto the blade bracket. The blade has thickness of about 5 mm, width of about 15 mm, and length of about 130 mm. The blade bracket was mounted on a PZT actuator (Piezo Systems, Inc.) that moved the blade from a first position to a second position. The PZT was driven by a linear amplifier (EPA-2104-115, Piezo System, Inc.).

Figure 7:
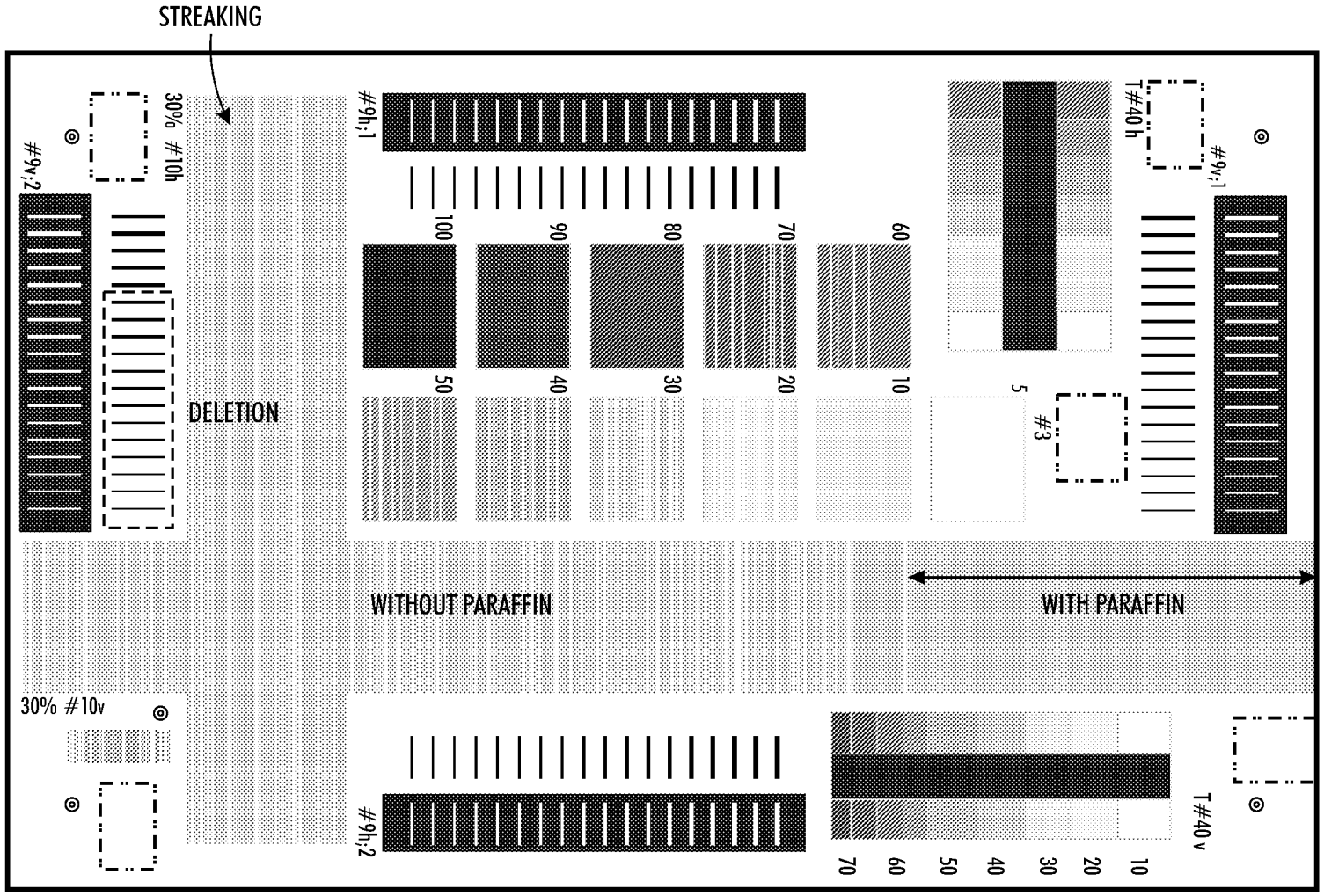
FIG. 7 is a print test demonstrating A-zone deletion results of prints made with the system according to embodiments described herein.

This type applicator with tapping or pulsing capability was successfully integrated in a Xerox DocuColor 250 CRU. The modified CRU with a low wear PASCO photoreceptor had been conditioned in A-zone before machine testing. The print test was performed with the Xerox DocuColor 250 machine in A-zone (28° C., 85% RH) to evaluate image quality, specifically A-zone deletion and BCR contamination. Overcoated P/R drums generally fail to turn in machines in A-zone due to high torque which results in "motor fault" errors. After installing the blade-type applicator onto the CRU and tapping the applicator at frequency of 200 Hz, the motor could turn the overcoated drums indicating that paraffin oil was supplied from the blade to lubricate the system. The blade applicator was approximately 130 mm in length (shorter than the full length of the P/R) so that paraffin oil was only applied onto a portion of the photoreceptor and the other portion (with no paraffin) was used as a control. This allowed the comparison on the image quality of prints obtained simultaneously from regions with and without applied paraffin oil. As shown in FIG. 7, the control section (no applied paraffin oil) has severe streaking in the image due to toner contamination on the BCR and/or blade chattering. The control section also resulted in severe A-zone deletion. In contrast, there was a dramatic improvement in image quality developed from the paraffin-applied P/R surface area.

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled in the art which are also encompassed by the following claims.

What is claimed is:

1. An applicator for use in an image forming apparatus comprising:

an applicator comprising an elastomeric matrix and a functional material dispersed therein; and an actuator for moving the applicator between a first position having the applicator in contact with a surface, and a second position, the actuator moving the applicator from the first position to the second position at a predetermined frequency wherein the functional material diffuses from the elastomeric matrix to the surface.

2. The applicator according to claim 1, wherein the predetermined frequency is from about $10^{-5}$ Hz to about 10 kHz.

3. The applicator according to claim 1, wherein a duty cycle for the contact in the first position is from about 5% to about 95%.

4. The applicator according to claim 1, wherein the elastomeric matrix comprises a material selected from the group consisting of polysiloxane, polyurethane, polyester, polyfluorosilioxanes, polyolefin, fluoroelastomer, synthetic rubber, natural rubber, and mixtures thereof.

5. The applicator according to claim 1, wherein the functional material is selected from the group consisting of alkanes, fluoroalkanes, alkyl silanes, fluoroalkyl silanes alkoxy-silanes, siloxanes, glycols or polyglycols, mineral oil, synthetic oil, natural oil, and mixtures thereof.

6. The applicator according to claim 1, wherein the functional material comprises a paraffin oil.

7. The applicator according to claim 1, wherein the actuator is selected from a piezo transducer, electrical motor, pneumatic actuator, hydraulic actuator, linear actuator, combo drive, thermal bimorphs and electroactive polymers.

8. The applicator according to claim 1, wherein the second position comprises having the applicator in contact with the surface at a pressure on the surface less than that of the first position.

9. The applicator according to claim 1, wherein the second position comprises having the applicator not in contact with the surface.

10. The applicator according to claim 1, wherein the applicator at an idle mode is lifted away from the surface.

11. The applicator according to claim 1, wherein the applicator at a running mode is moving between the first position and the second position.

12. The applicator according to claim 1, wherein the surface comprises an image bearing surface or a contact charging surface.

13. The applicator according to claim 1, wherein the applicator is selected from the group consisting of a blade and a roller.

14. An image forming apparatus comprising:

a) an image bearing member;

b) a contact charging unit for applying an electrostatic charge on the image bearing member to a predetermined electric potential;

c) an exposing unit that exposes a surface of the image bearing member charged by the charging unit to form an electrostatic latent image;

d) a developing unit that develops the electrostatic latent image using a developer containing toner to form a toner image;

(e) a transferring unit that transfers the toner image to a recording medium;

(f) a cleaning unit that removes toner remaining on the surface of the image bearing member;

g) an applicator disposed in contact with the surface of the image bearing member or a surface of the charging unit, wherein the lubricant applicator comprises:

an applicator comprising an elastomeric matrix and a functional material dispersed therein, wherein the applicator is positioned in contact with a surface of the imaging member or the charging unit; and an actuator for moving the applicator between a first position having the applicator in contact with the surface, and a second position, the actuator moving the applicator from the first position to the second position at a pre-determined frequency wherein the functional material diffuses from the elastomeric matrix to the surface.

15. The image forming apparatus according to claim 14, wherein the pre-determined frequency is from about $10^{-5}$ Hz to about 10 kHz.

16. The applicator of the imaging forming apparatus according to claim 14, wherein a duty cycle for the contact in the first position is from about 5% to about 95%.

17. The image forming apparatus according to claim 14, wherein the applicator is selected from the group consisting of a blade and a roller.

18. An image forming apparatus comprising:

a) an image bearing member b) a contact charging unit for applying an electrostatic charge on the image bearing member to a predetermined electric potential;

c) an applicator wherein the applicator comprises:

an applicator comprising an elastomeric matrix and a functional material dispersed therein, wherein the applicator is positioned in contact with a surface of the imaging member or the charging unit; and an actuator for moving the applicator between a first position having the applicator in contact with the surface, and a second position, the actuator moving the applicator from the first position to the second position at a pre-determined frequency wherein the functional material diffuses from the elastomeric matrix to the surface.

19. The image forming apparatus according to claim 18, wherein the pre-determined frequency is from about $10^{-5}$ Hz to about 10 kHz.

20. The imaging forming apparatus according to claim 18, wherein a duty cycle for the contact in the first position is from about 5% to about 95%.

* * * * *